US007727127B1

(12) United States Patent
Arrington

(10) Patent No.: US 7,727,127 B1
(45) Date of Patent: Jun. 1, 2010

(54) MULTI-STATION/ MULTI-FUNCTIONAL MARTIAL ARTS DEVICE

(76) Inventor: Wayne Arrington, 4603 Valleybrook Cir., College Station, TX (US) 77845

( * ) Notice: Subject to any disclaimer, the term of this patent is extended or adjusted under 35 U.S.C. 154(b) by 21 days.

(21) Appl. No.: 12/378,377

(22) Filed: Feb. 13, 2009

(51) Int. Cl.
*A63B 69/34* (2006.01)

(52) U.S. Cl. ..... 482/83; 482/87

(58) Field of Classification Search ..... 482/83–90
See application file for complete search history.

(56) References Cited

U.S. PATENT DOCUMENTS 3,427,021 A * 2/1969 Donato ..... 482/83
5,052,379 A * 10/1991 Airy et al. ..... 602/16
5,476,433 A * 12/1995 Bruner ..... 482/87
5,863,279 A * 1/1999 Pouliot ..... 482/83

* cited by examiner

*Primary Examiner*—Jerome Donnelly

(57) ABSTRACT

A board support assembly has a vertical axis. A plurality of training stations is attached to and extends radially from the board support assembly. One of the training stations includes interior and exterior plates. A pair of projections extends radially outwardly from the exterior plate. The projections have parallel exterior surfaces and an associated strap. In this manner a martial arts training board may be received and supported. The martial arts training board has edges positionable between the exterior surfaces of the projections and the straps. A rotation assembly includes a pivot pin. The pivot pin couples the interior and exterior plates for rotation about a horizontal axis.

1 Claim, 3 Drawing Sheets

FIG 5
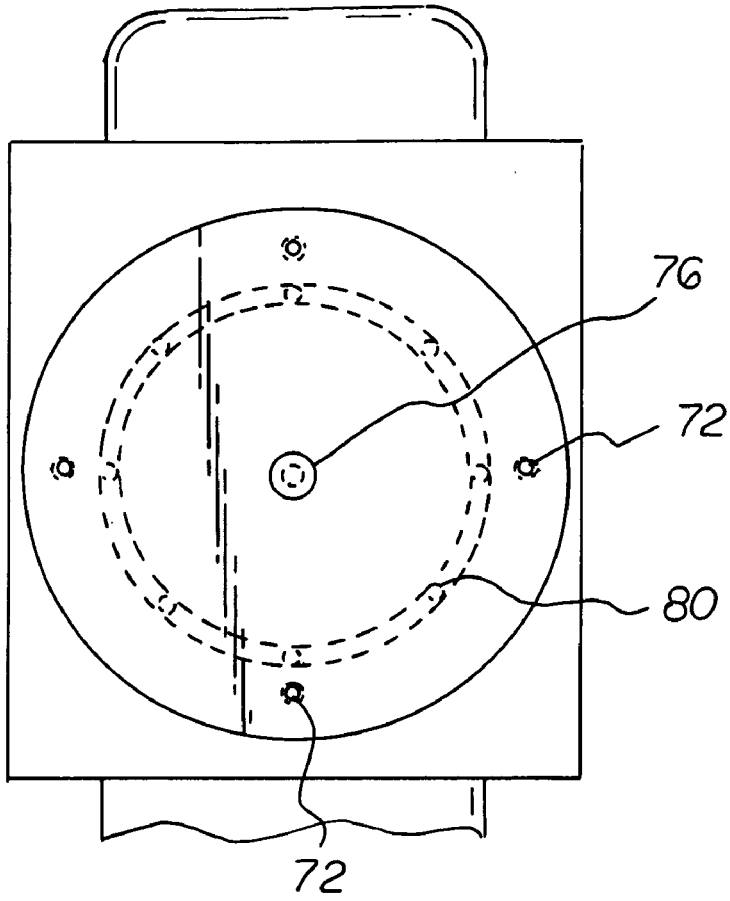
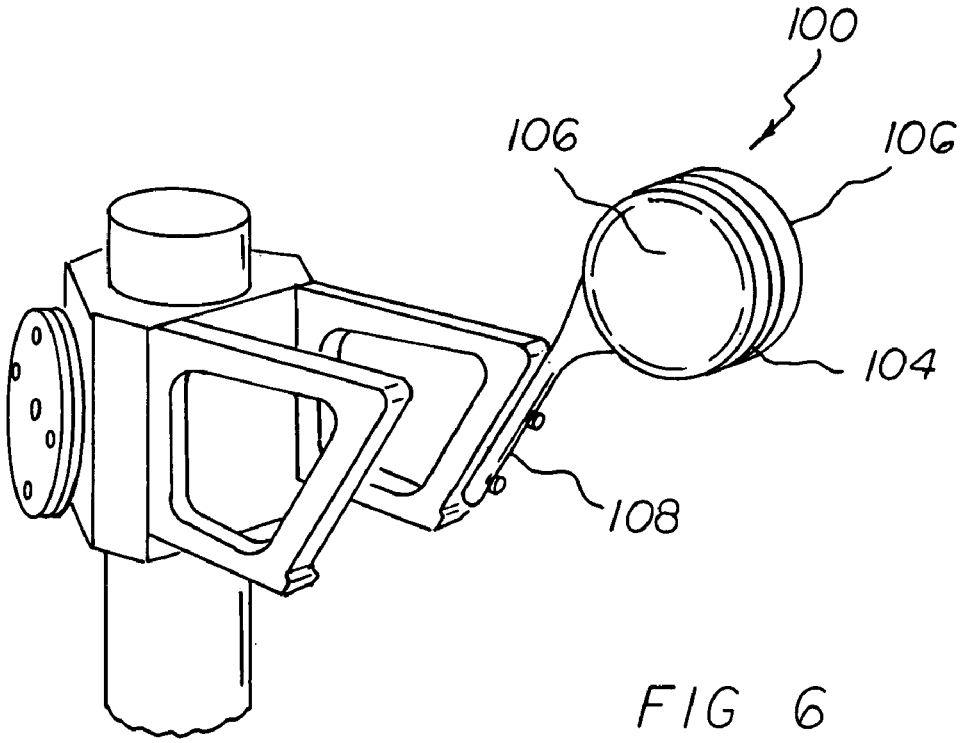
FIG 6

MULTI-STATION/ MULTI-FUNCTIONAL MARTIAL ARTS DEVICE

BACKGROUND OF THE INVENTION

Field of the Invention

The present invention relates to a multi-station/multi-functional martial arts device and more particularly pertains to coordination and strength training of students of the martial arts.

SUMMARY OF THE INVENTION

In view of the foregoing disadvantages inherent in training devices of known designs and configurations now present in the prior art, the present invention provides an improved multi-station/multi-functional martial arts device. As such, the general purpose of the present invention, which will be described subsequently in greater detail, is to provide a new and improved multi-station/multi-functional martial arts device and method which has all the advantages of the prior art and none of the disadvantages.

To attain this, the present invention essentially comprises a multi-station/multi-functional martial arts device. First provided is a base unit. The base unit has a substantially planar floor resting surface. The base unit has an interior void. In this manner ballast material is reversibly encased. The ballast material is material such as sand or water.

A cylindrical elongate support column is provided. The support column has a proximal end. The support column has a distal end. The support column is attached to the base unit at the proximal end of the support column. The support column extends vertically along an axial centerline in a direction substantially opposite the substantially planar floor resting surface.

Provided next is a board support assembly. The board support assembly has a lower end. The board support assembly has upper end. The board support assembly has a recess. The recess is sized and shaped for telescopic reception of the support column. The board support assembly has a vertical axis.

Three training stations are provided. The training stations include a first training station. The training stations include a second training station. The training stations include a third training station. The training stations are attached to and extending radially from the board support assembly. A first horizontal axis is provided. A second horizontal axis is provided. A third horizontal axis is provided. The three training stations are equally spaced angularly along the first horizontal axis, the second horizontal axis and the third horizontal axis. The three horizontal axes are in a common horizontal plane. The three horizontal axes radiate from the vertical axis of the board support assembly at 120 degrees from one another.

The first training station includes a resilient pad. The resilient pad has an exterior surface. The exterior surface is adapted to be struck by a user. The exterior surface is generally planar in configuration. The exterior surface is located along the first horizontal axis. The exterior surface is in a plane perpendicular to the floor resting surface.

The second training station includes a pair of parallel projections. The parallel projections have parallel exterior surfaces. Each of the exterior surfaces has an associated strap. A fixedly positioned martial arts training board, not shown, is provided. The fixedly positioned martial arts training board has an interior face in contact with the exterior surfaces of the parallel projections. The fixedly positioned martial arts training board has an exterior face. The exterior face is provided in contact with and supported by the straps. The fixedly positioned martial arts training board is adapted to be struck by the user between the parallel projections. The fixedly positioned martial arts training board is generally planar in configuration. The fixedly positioned martial arts training board is located along the second horizontal axis. The fixedly positioned martial arts training board has an upper edge. The fixedly positioned martial arts training board has a lower edge. The lower edge is located closer to the board support assembly than to the upper edge.

The third training station includes an interior plate 58. The interior plate is generally planar in configuration. The interior plate is located along the third horizontal axis. The interior plate is in a plane perpendicular to the floor resting surface. The third training station also includes an exterior plate. The exterior plate is generally planar in configuration. The exterior plate is located along the third horizontal axis. The exterior plate is in the plane perpendicular to the floor resting surface. The third training station includes a separable plate. The separable plate has a pair of supplemental projections. The supplemental projections extend radially outwardly from the separable plate. The supplemental projections have parallel exterior surfaces. Each of the exterior surfaces has an associated strap. The third training station has a repositionable martial arts training board. The repositionable martial arts training board has an interior surface. The interior surface is provided in contact with the exterior surfaces. The repositionable martial arts training board has an exterior surface. The exterior surface is provided in contact with and supported by the straps. The repositionable martial arts training board is adapted to be struck by the user between the supplemental projections. The repositionable martial arts training board is generally planar in configuration. The repositionable martial arts training board is located along the third horizontal axis. The separable plate has bolts. The bolts separably couple the separable plate from the exterior plate for use independent of the remainder of the system.

Provided last is a rotation assembly. The rotation assembly includes a pivot pin. The pivot pin rotatably couples the interior and exterior plates. The pivot pin is located along the third horizontal axis. The rotation assembly includes a plurality of recesses. The recesses are provided in the interior plate. The recess are provided in a circular configuration around the pivot pin. The rotation assembly includes a plurality of spring urged balls. The spring urged balls are provided in the exterior plate. The spring urged balls are provided in a circular configuration around the pivot pin. The balls are selectively positionable in the recesses. In this manner the angular orientation of the exterior plate and the repositionable martial arts training board may be varied.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-station/multi-functional martial arts device which has all of the advantages of the prior art training devices of known designs and configurations and none of the disadvantages.

It is another object of the present invention to provide a new and improved multi-station/multi-functional martial arts device which may be easily and efficiently manufactured and marketed.

It is further object of the present invention to provide a new and improved multi-station/multi-functional martial arts device which is of durable and reliable constructions.

An even further object of the present invention is to provide a new and improved multi-station/multi-functional martial arts device which is susceptible of a low cost of manufacture with regard to both materials and labor, and which accordingly is then susceptible of low prices of sale to the consuming public, thereby making such multi-station/multi-functional martial arts device economically available to the buying public.

Even still another object of the present invention is to provide a multi-station/multi-functional martial arts device for coordination and strength training of students of the martial arts.

Lastly, it is an object of the present invention to provide a new and improved multi-station/multi-functional martial arts device. A board support assembly has a vertical axis. A plurality of training stations is attached to and extends radially from the board support assembly. One of the training stations includes interior and exterior plates. A pair of projections extends radially outwardly from the exterior plate. The projections have parallel exterior surfaces and an associated strap. In this manner a martial arts training board may be received and supported. The martial arts training board has edges positionable between the exterior surfaces of the projections and the straps. A rotation assembly includes a pivot pin. The pivot pin couples the interior and exterior plates for rotation about a horizontal axis.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a plan view of the third training station taken along line 5-5 of FIG. 4.

FIG. 6 is a perspective illustration of the second training station configured in accordance with an alternate embodiment of the invention.

The same reference numerals refer to the same parts throughout the various Figures.

DESCRIPTION OF THE PREFERRED EMBODIMENT

Figure 1:
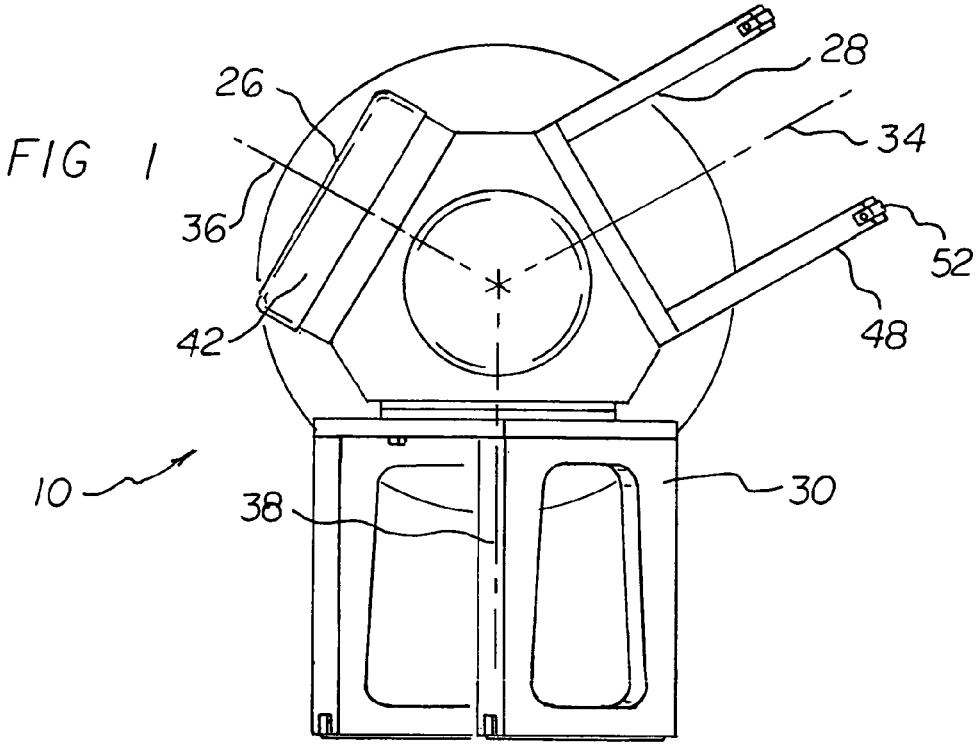
FIG. 1 is a plan view of a multi-station/multi-functional martial arts device constructed in accordance with the principles of the present invention.
Figure 2:
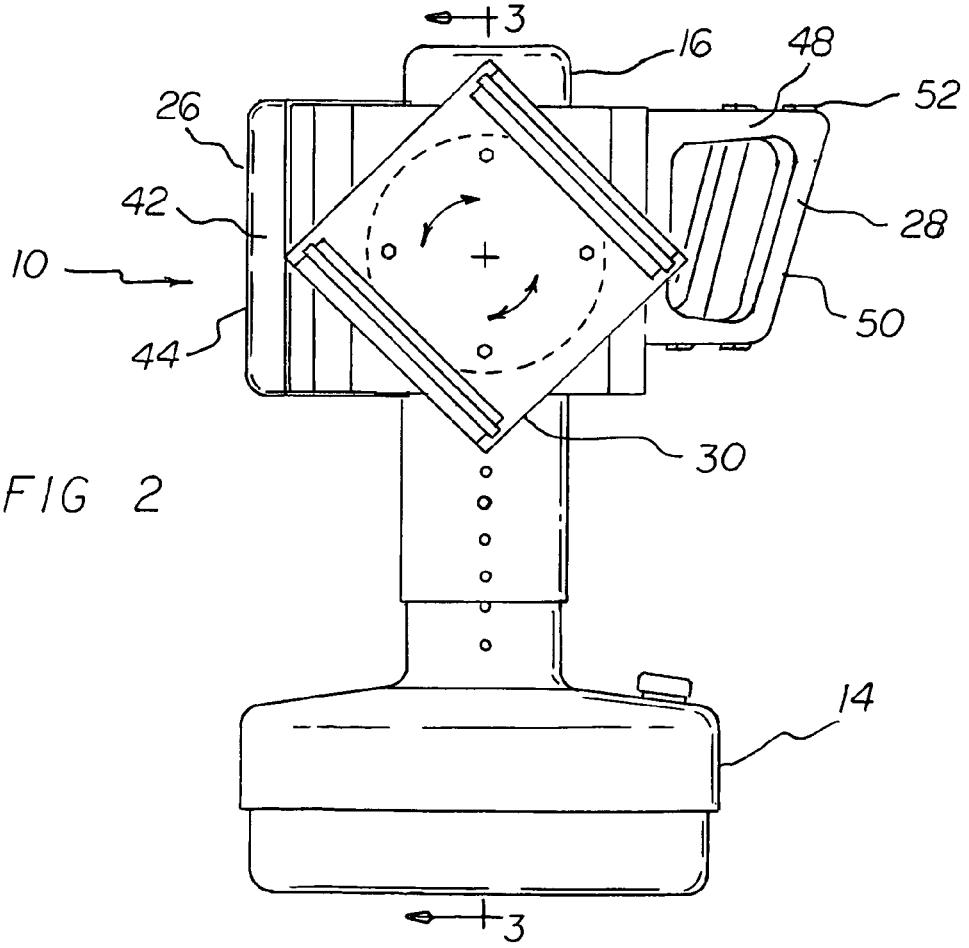
FIG. 2 is a front elevational view of the device shown in FIG. 1.
Figure 3:
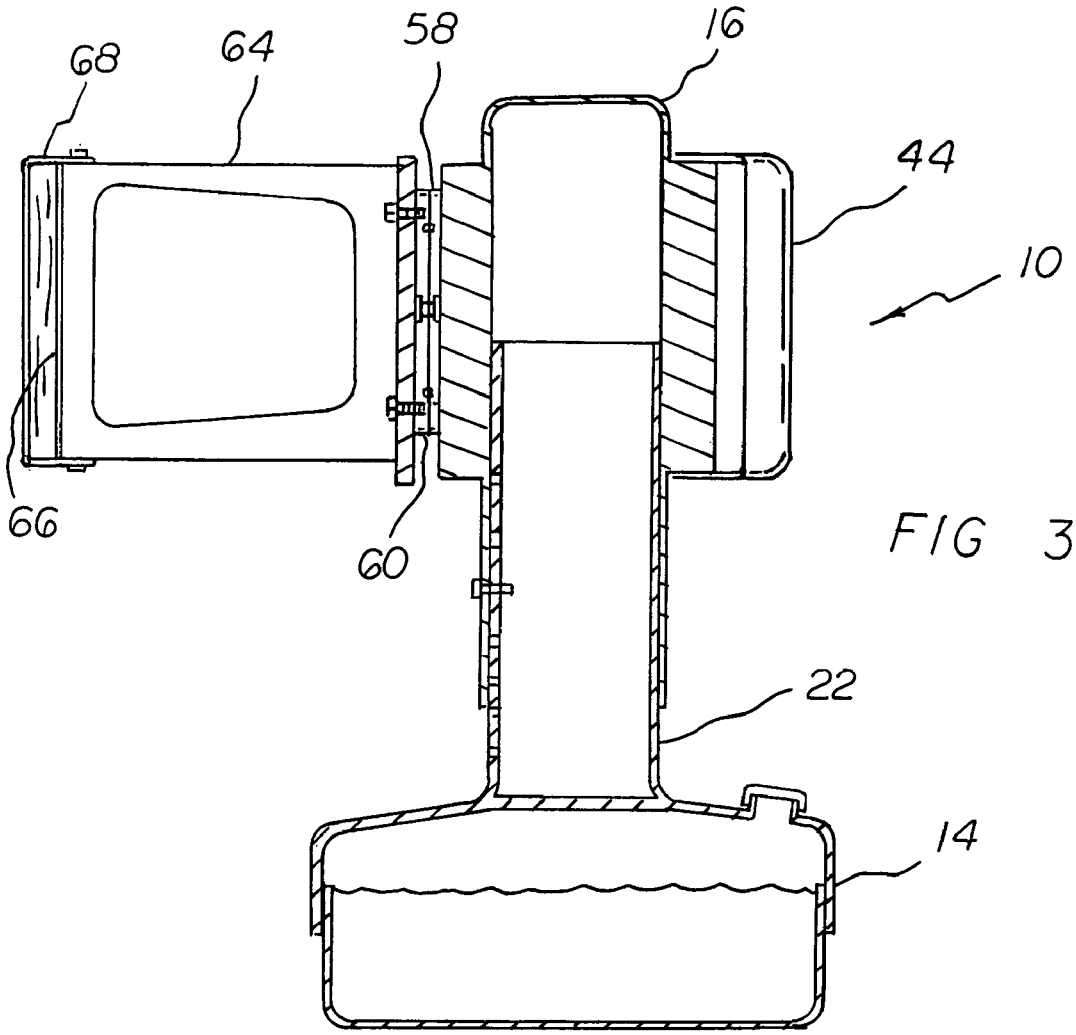
FIG. 3 is a cross sectional view taken along line 3-3 of FIG. 2.
Figure 4:
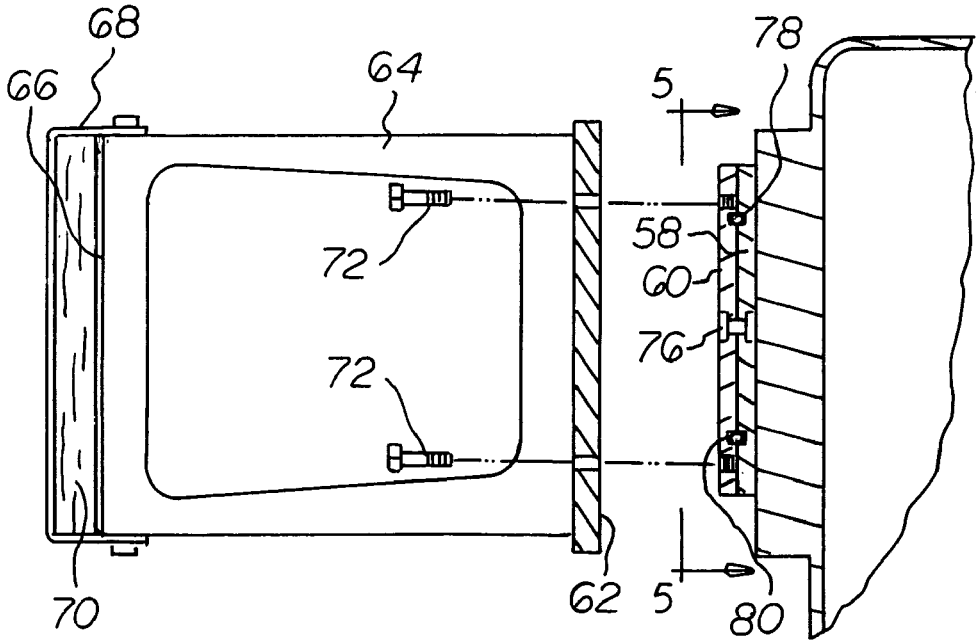
FIG. 4 is an exploded sectional view of the third training station shown in FIG. 3.

With reference now to the drawings, and in particular to FIG. 1 thereof, the preferred embodiment of the new and improved multi-station/multi-functional martial arts device embodying the principles and concepts of the present invention and generally designated by the reference numeral 10 will be described.

The present invention, the multi-station/multi-functional martial arts device 10 is comprised of a plurality of components. Such components in their broadest context include a board support assembly, a plurality of training stations, and a rotation assembly. Such components are individually configured and correlated with respect to each other so as to attain the desired objective.

First provided is a base unit 14. The base unit has a substantially planar floor resting surface. The base unit has an interior void. In this manner ballast material is reversibly encased. The ballast material is material such as sand or water.

A cylindrical elongate support column 22 is provided. The support column has a proximal end. The support column has a distal end. The support column is attached to the base unit at the proximal end of the support column. The support column extends vertically along an axial centerline in a direction substantially opposite the substantially planar floor resting surface.

Provided next is a board support assembly 16. The board support assembly has a lower end. The board support assembly has upper end. The board support assembly has a recess. The recess is sized and shaped for telescopic reception of the support column. The board support assembly has a vertical axis.

Three training stations are provided. The training stations include a first training station 26. The training stations include a second training station 28. The training stations include a third training station 30. The training stations are attached to and extending radially from the board support assembly. A first horizontal axis 34 is provided. A second horizontal axis 36 is provided. A third horizontal axis 38 is provided. The three training stations are equally spaced angularly along the first horizontal axis, the second horizontal axis and the third horizontal axis. The three horizontal axes are in a common horizontal plane. The three horizontal axes radiate from the vertical axis of the board support assembly at 120 degrees from one another.

The first training station includes a resilient pad 42. The resilient pad has an exterior surface 44. The exterior surface is adapted to be struck by a user. The exterior surface is generally planar in configuration. The exterior surface is located along the first horizontal axis. The exterior surface is in a plane perpendicular to the floor resting surface.

The second training station includes a pair of parallel projections 48. The parallel projections have parallel exterior surfaces 50. Each of the exterior surfaces has an associated strap 52. A fixedly positioned martial arts training board, not shown, is provided. The fixedly positioned martial arts training board has an interior face in contact with the exterior surfaces of the parallel projections. The fixedly positioned martial arts training board has an exterior face. The exterior face is provided in contact with and supported by the straps. The fixedly positioned martial arts training board is adapted to be struck by the user between the parallel projections. The fixedly positioned martial arts training board is generally planar in configuration. The fixedly positioned martial arts training board is located along the second horizontal axis. The fixedly positioned martial arts training board has an upper edge. The fixedly positioned martial arts training board has a lower edge. The lower edge is located closer to the board support assembly than to the upper edge.

The third training station includes an interior plate 58. The interior plate is generally planar in configuration. The interior plate is located along the third horizontal axis. The interior plate is in a plane perpendicular to the floor resting surface. The third training station also includes an exterior plate 60. The exterior plate is generally planar in configuration. The exterior plate is located along the third horizontal axis. The exterior plate is in the plane perpendicular to the floor resting surface. The third training station includes a separable plate 62. The separable plate has a pair of supplemental projections 64. The supplemental projections extend radially outwardly from the separable plate. The supplemental projections have parallel exterior surfaces 66. Each of the exterior surfaces has an associated strap 68. The third training station has a repositionable martial arts training board 70. The repositionable martial arts training board has an interior surface. The interior surface is provided in contact with the exterior surfaces. The repositionable martial arts training board has an exterior surface. The exterior surface is provided in contact with and supported by the straps. The repositionable martial arts training board is adapted to be struck by the user between the supplemental projections. The repositionable martial arts training board is generally planar in configuration. The repositionable martial arts training board is located along the third horizontal axis. The separable plate has bolts 72. The bolts separably couple the separable plate from the exterior plate for use independent of the remainder of the system.

Provided last is a rotation assembly. The rotation assembly includes a pivot pin 76. The pivot pin rotatably couples the interior and exterior plates. The pivot pin is located along the third horizontal axis. The rotation assembly includes a plurality of recesses 78. The recesses are provided in the interior plate. The recess are provided in a circular configuration around the pivot pin. The rotation assembly includes a plurality of spring urged balls 80. The spring urged balls are provided in the exterior plate. The spring urged balls are provided in a circular configuration around the pivot pin. The balls are selectively positionable in the recesses. In this manner the angular orientation of the exterior plate and the repositionable martial arts training board may be varied.

Note the alternate embodiment 100 of the invention illustrated in FIG. 6. A padded kicking target 104 is provided. The padded kicking target has opposed circular faces 106. The opposed circular faces are of a resilient material. The padded kicking target has a downwardly extending arm 108. The downwardly extending arm has apertures. In this manner bolts may be received. Further in this manner the padded kicking target may be secured at any appropriate location of the board support assembly.

All of the function described in U.S. Pat. No. 7,207,928 is incorporated in the present invention and then adds a rotation assembly, a swivel, that allows the boards to be positioned at different angles as well. Resilient pad 42, a padded focus target device, is added to the first training station for practicing rapid punching or kicking. In an alternate embodiment, a padded kicking target 104 has been added for use in practicing crescent kicks and spin heal kicks which provides only a little resistance to prevent injuries. Arms 64 are mounted on the rotation assembly, swivel, to the third training station allowing rotation of 360 degrees for horizontal, vertical or angle mounting. The arms 64 can be removed from the rotation assembly, swivel, or provided separately as a single board holding device that can be hand held, mounted to the wall or strapped to a punching bag.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-station/multi-functional martial arts device, the device comprising, in combination:

a base unit having a substantially planar floor resting surface, the base unit having an interior void for reversibly encasing ballast material;

a cylindrical elongate support column having a proximal end and a distal end, the support column being attached to the base unit at the proximal end of the support column and extending vertically along an axial centerline in a direction substantially opposite the substantially planar floor resting surface;

a board support assembly having a lower end and an upper end and having a recess sized and shaped for telescopic reception of the support column, the board support assembly having a vertical axis;

three training stations being a first training station, a second training station, and a third training station, the training stations attached to and extending radially from the board support assembly, the three training stations being equally spaced angularly along a first horizontal axis, a second horizontal axis and a third horizontal axis, the three horizontal axes being in a common horizontal plane radiating from the vertical axis of the board support assembly at 120 degrees from one another;

the first training station including a resilient pad with an exterior surface adapted to be struck by a user, the exterior surface being generally planar in configuration, the exterior surface located along the first horizontal axis, the exterior surface being in a plane perpendicular to the floor resting surface;

the second training station including a pair of parallel projections, the parallel projections having parallel exterior surfaces, each of the exterior surfaces having an associated strap, a fixedly positioned martial arts training board, not shown, having an interior face in contact with the exterior surfaces of the parallel projections, the fixedly positioned martial arts training board having an exterior face in contact with and supported by the straps, the fixedly positioned martial arts training board being adapted to be struck by the user between the parallel projections, the fixedly positioned martial arts training board being generally planar in configuration, the fixedly positioned martial arts training board being located along the second horizontal axis, the fixedly positioned martial arts training board having an upper edge and having a lower edge with the lower edge located closer to the board support assembly than to the upper edge;

the third training station including an interior plate, the interior plate being generally planar in configuration, the interior plate located along the third horizontal axis, the interior plate being in a plane perpendicular to the floor resting surface, the third training station also including an exterior plate being generally planar in configuration, the exterior plate located along the third horizontal axis, the exterior plate being in the plane perpendicular to the floor resting surface, a separable plate with a pair of supplemental projections extending radially outwardly from the separable plate, the supplemental projections having parallel exterior surfaces, each of the exterior surfaces having an associated strap, a repositionable martial arts training board having an interior surface in contact with the exterior surfaces, the repositionable martial arts training board having an exterior surface in contact with and supported by the straps, the repositionable martial arts training board adapted to be struck by the user between the supplemental projections, the repositionable martial arts training board being generally planar in configuration, the repositionable martial arts training board located along the third horizontal axis, the separable plate having bolts separably coupling the separable plate from the exterior plate for use independent of the remainder of the system; and a rotation assembly including a pivot pin rotatably coupling the interior and exterior plates, the pivot pin being located along the third horizontal axis, the rotation assembly including a plurality of recesses in the interior plate in a circular configuration around the pivot pin and a plurality of spring urged balls in the exterior plate in a circular configuration around the pivot pin, the balls being selectively positionable in the recesses to vary the angular orientation of the exterior plate and the repositionable martial arts training board.

* * * * *